US008864191B2

(12) United States Patent
Muller et al.

(10) Patent No.: US 8,864,191 B2
(45) Date of Patent: Oct. 21, 2014

(54) DEVICE FOR ACTUATING THE CLOSURE OF A MOVABLE PART

(75) Inventors: Dirk Muller, Essen (DE); Ralf Lennhoff, Hagen (DE)

(73) Assignee: Huf Hulsbeck & Furst GmbH & Co. KG (DE)

( * ) Notice: Subject to any disclaimer, the term of this patent is extended or adjusted under 35 U.S.C. 154(b) by 643 days.

(21) Appl. No.: 12/663,768

(22) PCT Filed: May 30, 2008

(86) PCT No.: PCT/EP2008/056704
§ 371 (c)(1),
(2), (4) Date: Dec. 9, 2009

(87) PCT Pub. No.: WO2008/151950
PCT Pub. Date: Dec. 18, 2008

(65) Prior Publication Data

US 2010/0171327 A1 Jul. 8, 2010

(30) Foreign Application Priority Data

Jun. 13, 2007 (DE) ..... 10 2007 027 848

(51) Int. Cl.
*E05B 3/00* (2006.01)
*E05B 85/16* (2014.01)
*E05B 77/06* (2014.01)

(52) U.S. Cl.
CPC *E05B 85/16* (2013.01); *E05B 77/06* (2013.01)
USPC ..... 292/336.3

(58) Field of Classification Search
CPC ..... E05B 85/10; E05B 79/06; E05B 79/22; E05B 85/14; E05B 85/16
USPC ..... 292/336.3, 347–356, DIG. 8, DIG. 22, 292/DIG. 27, DIG. 31, DIG. 23, DIG. 30; 16/412
See application file for complete search history.

(56) References Cited

U.S. PATENT DOCUMENTS 3,159,415 A * 12/1964 Sandor ..... 292/336.3
4,475,754 A * 10/1984 Arlauskas et al. ..... 292/336.3

(Continued)

FOREIGN PATENT DOCUMENTS

DE 3628376 A1 * 2/1988
DE 10144151 C1 7/2003

(Continued)

OTHER PUBLICATIONS

Computer-Generated Translation of DE10217488 using EPO website.*

(Continued)

*Primary Examiner* — Carlos Lugo
*Assistant Examiner* — Alyson M Merlino
(74) *Attorney, Agent, or Firm* — Cantor Colburn LLP

(57) ABSTRACT

The invention relates to a device (10) for actuating the closure of a movable part (12) of a motor vehicle, in particular a door, or hatchback, or similar, comprising a support (11) that can be fixed to the inner face of the movable part (12), a bearing unit (20) that can be pivoted about a first axis (13) provided on the support (11) and a handle element (40) with a first (41) and a second end (42), said first and second end (41, 42) being located on the bearing unit (20). According to the invention, the bearing unit (20) is equipped with a retaining element (24) which lies at a distance from the first axis (13) and on which the first end (41) is situated. Said first end (41) at least partially surrounds the retaining element (24).

20 Claims, 3 Drawing Sheets

(56) References Cited

U.S. PATENT DOCUMENTS

| | | | | | |
|---|---|---|---|---|---|
| 4,482,179 | A * | 11/1984 | Johnson | 292/336.3 |
| 5,123,687 | A * | 6/1992 | Pfeiffer et al. | 292/336.3 |
| 5,860,684 | A * | 1/1999 | Mizuki | 292/336.3 |
| 5,887,918 | A * | 3/1999 | Okada et al. | 292/336.3 |
| 5,975,597 | A * | 11/1999 | Makiuchi et al. | 292/336.3 |
| 6,007,122 | A * | 12/1999 | Linder et al. | 292/336.3 |
| 6,234,041 | B1 * | 5/2001 | Larabet et al. | 74/523 |
| 6,363,577 | B1 * | 4/2002 | Spitzley | 292/336.3 |
| 6,378,921 | B1 * | 4/2002 | Deischl et al. | 292/336.3 |
| 6,415,636 | B1 * | 7/2002 | Fukumoto et al. | 70/208 |
| 6,447,030 | B1 * | 9/2002 | Meinke | 292/347 |
| 6,543,090 | B2 * | 4/2003 | Muneta | 16/412 |
| 6,880,870 | B2 * | 4/2005 | Costigan | 292/336.3 |
| 6,910,303 | B1 * | 6/2005 | Mathofer | 49/503 |
| 7,070,216 | B2 * | 7/2006 | von zur Muehlen | 292/336.3 |
| 7,303,217 | B2 * | 12/2007 | Savant | 292/336.3 |
| 7,827,736 | B2 * | 11/2010 | Sunahara et al. | 49/503 |
| 2003/0122385 | A1 * | 7/2003 | Monig | 292/336.3 |
| 2004/0129040 | A1 * | 7/2004 | Mathofer et al. | 70/208 |
| 2004/0217602 | A1 * | 11/2004 | Nomura et al. | 292/336.3 |
| 2005/0057049 | A1 * | 3/2005 | Choi | 292/336.3 |
| 2008/0036219 | A1 * | 2/2008 | Savant et al. | 292/336.3 |
| 2009/0302620 | A1 * | 12/2009 | Muller et al. | 292/336.3 |
| 2010/0171328 | A1 * | 7/2010 | Muller et al. | 292/336.3 |

FOREIGN PATENT DOCUMENTS

| | | | |
|---|---|---|---|
| DE | 10217488 | A1 | 11/2003 |
| DE | 10217488 | B4 | 6/2005 |
| EP | 1052349 | A1 | 11/2000 |
| WO | 9949162 | A1 | 9/1999 |

OTHER PUBLICATIONS

International Search Report PCT/EP2008/056704; Dated Nov. 3, 2008.

* cited by examiner

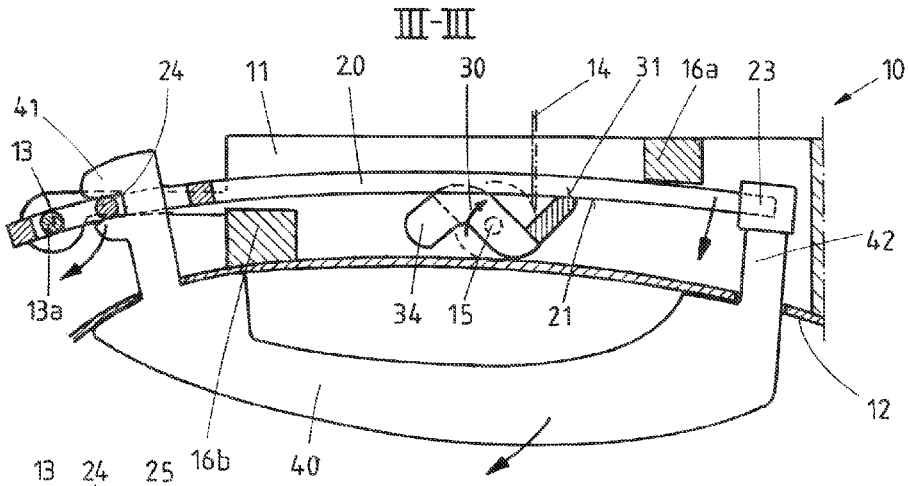
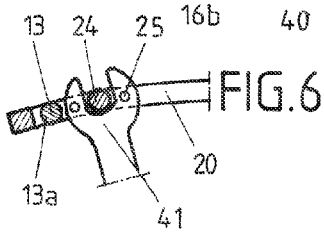
FIG.6
FIG.3
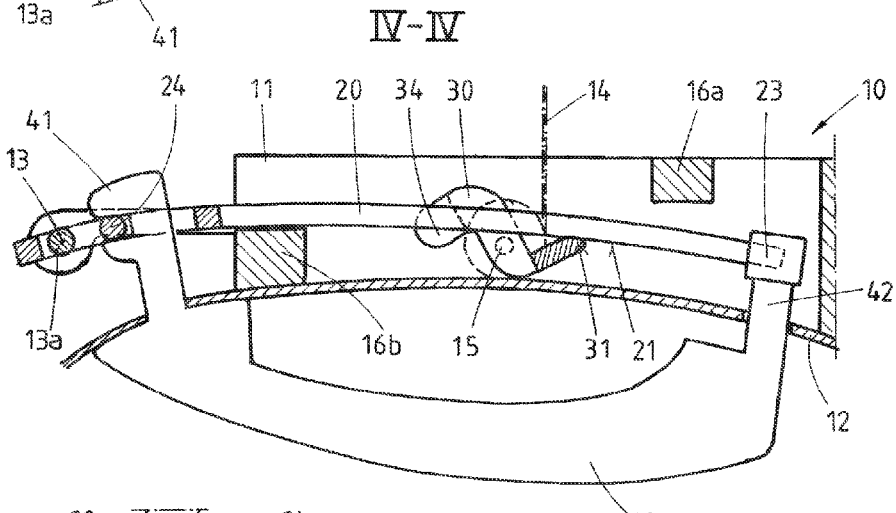
FIG.4
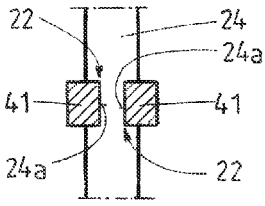
FIG.5

DEVICE FOR ACTUATING THE CLOSURE OF A MOVABLE PART

TECHNICAL FIELD

The invention relates to a device for operating a lock on a movable part of a motor vehicle, in particular a door or a tailgate or the like, having a carrier which can be attached to the inside of the movable part, a bearing unit which is pivotable about a first axis provided on the carrier and a grip element, which has a first and a second grip end, such that the first and second grip ends are arranged on the bearing unit.

BACKGROUND

DE 102 17 488 B4 discloses a device having a carrier which can be mounted from the inside of the door of the motor vehicle in the area of the exterior door panel. The carrier has a bearing pin for a bearing receptacle, which is situated in a bearing unit. Furthermore, a grip is provided, which can be connected at its first and second grip ends to the bearing unit, which is pivotable about an axis. The bearing unit is designed as a lever extending over the entire length of the grip. The process of installing the grip on the lever is accomplished by a resetting movement with two movement phases. First, the grip is moved perpendicular to the longitudinal axis of the lever in an insertion phase. Then in a displacement phase, the grip is moved parallel to the longitudinal axis of the lever. The first grip end of the grip here consists of a protruding journal that engages in a mating coupling part of the lever designed as a journal hole. The movement phases described here have proven to be complicated in assembly, which is a disadvantage.

BRIEF SUMMARY

The disclosure provides a device of the type defined above, with which the aforementioned disadvantages can be avoided, in particular to create a device with which the complexity of assembly of the grip element can be minimized.

To do so, it is provided according to the present invention that the bearing unit is configured with a holding element at a distance from the first axis, such that the first grip end is arranged on this holding element, and the first grip end at least partially surrounds the holding element.

In contrast to the prior art cited above, the configuration of the bearing unit is simplified. At the same time, the complexity of assembly is reduced because only the first grip end need be guided to the holding element without any complex movement phases such as those required in the prior art, whereby the first grip end surrounds the holding element in an area of its cross section in such a way that reliable positioning of the grip element on the movable part is ensured.

In the assembly of the grip element on the bearing unit, the first grip end is advantageously pivotable on the holding element. This facilitates the assembly process of the grip element. After the first grip element has been arranged on the holding element, in particular being in contact with it, the final position of the grip element can be achieved manually by a pivoting movement about the holding element. Then the second grip end, for example, may be attached to the bearing unit in a form-fitting and/or friction-locked or bonded manner.

It is especially advantageous that in an assembly of the grip element, the first grip end is guided to the holding element and then the second grip end is moved toward the bearing unit by a pivoting movement of the grip element around the holding element, the second grip end being attachable to the bearing unit. The holding element advantageously runs parallel to the first axis, about which the bearing unit can be pivoted. The bearing unit is embodied here as a type of "lever" which moves on the inside of the door as an element "accompanying" the grip. To minimize assembly costs, the carrier can be prefabricated with the bearing unit as a modular unit and attached to the inside of the moving part. The bearing unit is advantageously mounted on the carrier without any tolerance.

In a preferred embodiment of the invention, the holding element forms a one-piece component with the bearing unit. This component may be, for example, an injection molded part made of metal, in particular aluminum. As an alternative, a plastic material may also be used, of course.

In a special embodiment of the inventive device, the holding element has at least one positioning means, so that an improved horizontal positioning of the first grip end can be achieved. In this way, it is additionally possible to preclude an unwanted tilting mobility of the grip element. The positioning element causes the first grip end, in particular the grip element, to be reliably held in the horizontal position in each of its possible positions. Thus unwanted friction in the operation of the grip element can be effectively prevented. While the user is operating the grip element, according to the invention the grip element together with the bearing unit is pivoted about the first axis, such that the first and second grip ends are arranged fixedly and immovably on the bearing unit and are pivoted together with the bearing unit about the first axis. In addition, the positioning means serve to allow the first grip end to be attached to the holding element in the correct position. In one possible embodiment of the invention, the positioning means may be formed by a groove provided on the holding element. The first grip end is accommodated by the groove so that the grip end is in contact with the walls of the groove and thus a reliable horizontal bearing of the first grip end is ensured.

It is particularly advantageous that there is a loose fit between the grip end and the holding element. In a special embodiment of the inventive device, there is a zero fit between the first grip end and the holding element. Since the bearing unit with the grip element can simultaneously move about the first axis during the operation of the grip element, there cannot be any friction between the first grip end and the holding element or the second grip end and the bearing unit. There is preferably a tolerance-free clamping of the first grip end on the holding element in x, y and z direction. In this way unwanted friction spots on the inventive device can be prevented.

The first axis is advantageously formed by a pin on which the bearing unit is pivotably mounted. The one end of the bearing unit preferably forms a closed bearing on the first axis. The pin here may extend through bearing bores in the bearing unit such that the pin, which may be cylindrical in configuration, is attached at its free ends to the carrier.

One measure for improving the invention may provide for the first grip end to be configured as an elongated hole that is open at one end, such that the first grip end surrounds the holding element in at least some areas. The installation complexity of the arrangement of the first grip end on the holding element is thereby greatly simplified. In addition, tolerances which may occur in injection molding of the relevant components such as the grip element, bearing unit, etc., or which may occur with temperature fluctuations can be effectively compensated over the aforementioned longitudinal hole on the first grip end. In one possible embodiment of the invention, in one of the last assembly steps, the grip element is guided from the outside through openings in the movable part on the bearing unit, such that a reliable fixation of the first and second grip ends on the bearing unit occurs. This assembly is preferably performed at defined temperatures. Then under normal conditions under which high temperature fluctuations may also occur, there may also be expansion of the grip element, for example. Since the first and second grip ends are each fixedly arranged on the bearing unit, no changes in position can occur in these locations due to temperature fluctuations, thereby ensuring reliable functioning of the device, in particular a reliable movement of the grip element in manual operation.

In addition, it is possible to provide for the area of the first grip end which is open at one end to be aligned toward the first axis. In this exemplary embodiment, the elongated hole in the first grip end is held against the holding element of the bearing unit such that no additional fastening means are needed for the grip element in the area of the first grip end in an advantageous manner.

In another alternative, the area of the first grip end which is open at one end is aligned toward the interior of the motor vehicle. In this case, it may be reasonable to additionally attach the grip element to the holding element in the area of the first grip end in a form-fitting and/or friction-locked and/or physically bonded manner. In the assembly procedure, for example, the first grip end may be attached to the holding element via additional catch elements.

It is especially advantageous that an outgoing unit leading to the lock is provided on the bearing unit and/or on the grip element. In the operation of the grip element, the lock of the movable part of the vehicle is operated via the outgoing unit, in particular being opened when an unlocked position is provided in the lock. The lock cylinder of the inventive device may also be connected to an additional outgoing unit which acts on the lock in operation of the lock cylinder, thereby locking or unlocking the lock. The outgoing unit may be implemented via a Bowden cable, for example.

As an alternative, a coupling element rotatably mounted on a second axis of rotation may be provided, an outgoing unit leading to the lock acting on this coupling element and the coupling element being in operative connection with the bearing unit. In an operation of the grip element, the bearing unit is at the same time pivoted about the first axis, whereby the bearing unit moves the coupling element so that the outgoing unit is also moved via the coupling element. The bearing unit is preferably pivotable together with the grip element out of a first position into a second position and vice-versa. The first position here is the resting position. In the second position of the grip element, an operation of the lock to open the movable part is triggered, whereby the grip element has previously been moved by a defined angle range out of the movable part around the first axis of rotation. In its first position, the bearing unit preferably contacts a first stop element. In the second position, the bearing unit may contact a second stop element in the second position. [1] Said stop elements may be integrated into the stationary carrier, for example.

[1] Translator's Note: Redundant phrase "in the second position" in this short sentence.

In a special embodiment, a spring element which is in operative connection with the coupling element and the bearing unit is provided, such that in the second position of the bearing unit, the spring element exerts a restoring force such that the bearing unit is automatically movable into its first position. The coupling element may preferably be configured with a receptacle in which the outgoing unit is held. The outgoing unit may be attached at its one end to said receptacle in a form-fitting and/or friction-locked and/or bonded manner.

In order for operation of the lock and an opening of the movable part, in particular the vehicle door, not to occur in a side impact, at least one mass equalizing weight is integrated into the inventive device. An especially compact configuration is achieved by integrating the mass equalizing weight into the coupling element.

In addition it is possible to provide for the inventive device to be monitored by an electric controller. For technical safety reasons, it may be advantageous if, in addition to detecting the position of the bearing unit, the positions of the grip element or the coupling element are also detected. This may be accomplished by means of sensors, for example, in particular magnetic field sensors which detect the magnetic field of a permanent magnet attached to the coupling element, to the bearing unit or to the grip element.

BRIEF DESCRIPTION OF THE DRAWINGS

Additional advantages, features and details of the present invention are derived from the following description in which exemplary embodiments of the invention are described in detail with reference to the drawings. The features mentioned in the claims and in the description may be essential to the invention either individually or in any combination. In the drawings:

FIG. 3 shows a simplified sectional view according to the sectional line III-III from FIG. 1, FIG. 4 shows a simplified sectional view according to the sectional line IV-IV from FIG. 2, FIG. 5 shows an alternative embodiment of the invention in an enlarged diagram in the area of the first axis of rotation and FIG. 6 shows another alternative embodiment of the invention in an enlarged diagram in the area of the first grip end.

DETAILED DESCRIPTION

Figure 1:
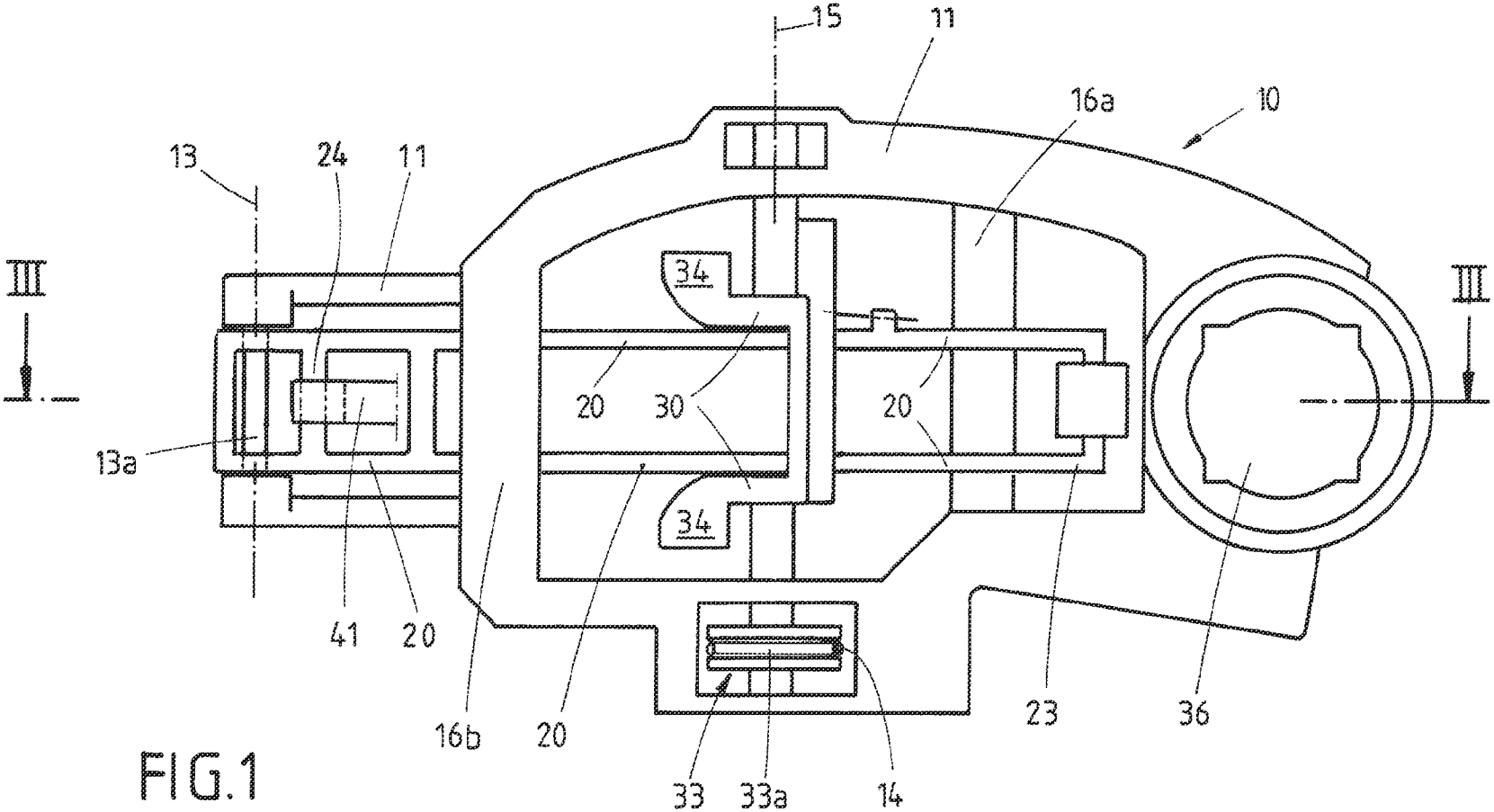
FIG. 1 shows a simplified diagram of an inventive device for operation of a lock on a motor vehicle door in a first position.

FIG. 1 to FIG. 4 show an inventive device 10 for operation of a lock on a motor vehicle door 12. The device 10 has a stationary carrier 11 which is attached to the inside of the movable door 12. A first axis 13 is provided on the left area of the carrier 11, a bearing unit 20 being pivotably arranged thereon. The bearing unit 20 is embodied as a type of lever. As shown in FIGS. 3 and 4, the grip element 40 has a first and a second grip end 41, 42 such that the second grip end 42 is attached to the free end 23 of the bearing unit 20.

The bearing unit 20 is embodied with a holding element 24 at a distance from the first axis 13, the first grip end 41 being arranged thereon, such that the first grip end 41 at least partially surrounds the holding element 24. In the present embodiment of the invention, the first grip end 41 is configured as an open elongated hole at one end, wherein the first grip end 41 with its elongated hole surrounds the first axis 13 at least in some areas. The first axis 13 has a pin 13*a* which is arranged on the left area of the carrier 11. The bearing unit 20 is mounted to pivot about the pin 13*a* wherein the pin 13*a* extends through bores (not shown) in the bearing unit 20.

Figure 2:
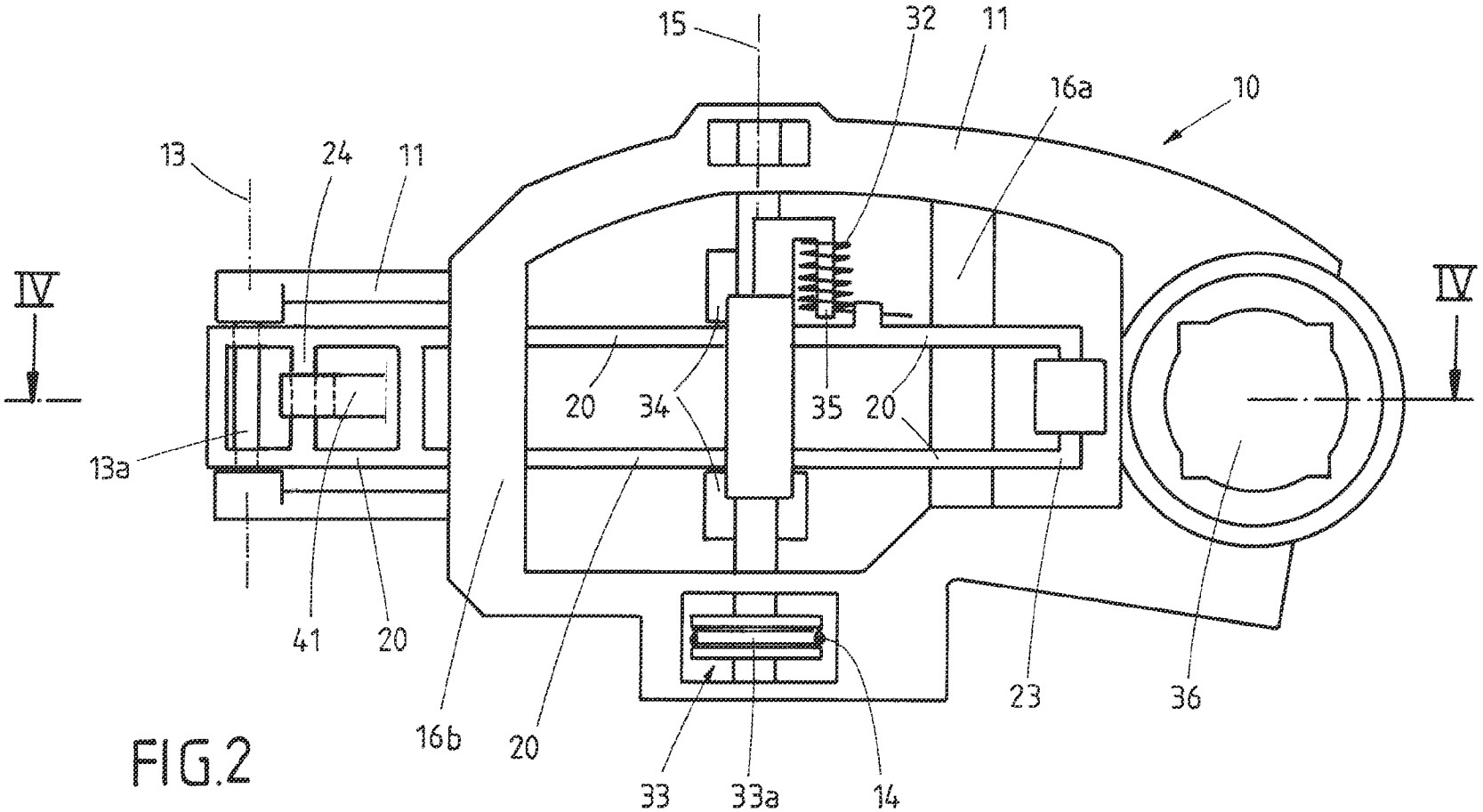
FIG. 2 shows the inventive device according to FIG. 2 in a second position.

In the present exemplary embodiment, there is a loose fit with some play between the first grip end 41 and the holding element 24. If the user operates the grip element 40, as indicated in FIGS. 2 and 4, then the bearing unit 20 is pivoted about the first axis 13 via the second grip end 42. Since the bearing unit 20 and the grip element 40 are moving in parallel, there is no relative movement between the two said components 20, 40, therefore there cannot be any friction between the two components 20, 40.

It is particularly advantageous that in the assembly of the grip element 40 on the bearing unit 20, the first grip end 41 is pivotable on the holding element 24. In the process of assembly of the grip element 40, the first grip end 41 is guided on the holding element 24, and then the second grip end 42 is moved by a pivoting movement of the grip element 40 about the holding element 24 toward the bearing unit 20 to which the second grip end 42 is then attached. This may be a form-fitting and/or friction-locked and/or bonded connection, for example. In the exemplary embodiment shown here, the second grip end 42 is connected to the bearing unit 20 by a screw connection 25, although it is not shown explicitly here.

As shown in FIG. 1 to FIG. 4, the holding element 24 runs parallel to the first axis 13. The holding element 24 with the bearing unit 20 forms a one-piece component here. The holding element 24, which is provided as a type of connecting strut within the construction of the bearing unit 20, forms a one-piece component together with the bearing unit 20. In addition, the holding element 24 serves as a reinforcement in the bearing unit 20. FIGS. 3 and 4 show clearly that the area of the first grip end 41 which is open at one end is aligned toward the first axis 13. This means that the elongated hole in the first grip end 41 is facing the first axis 13.

In another alternative of the invention, the area of the first grip end 41 that is open at one end may be directed toward the interior of the motor vehicle, which is shown in the schematic diagram in FIG. 6. In this embodiment according to FIG. 6, a screw connection 25 is additionally provided, reliably securing the first grip end 41 on the holding element 24. In contrast to this, no additional fastening element is required according to FIG. 1 to FIG. 4 to secure the first grip end 41 on the holding element 24.

In addition, FIGS. 1 to 4 show an outgoing unit 14 leading to the lock. In the present exemplary embodiment, the outgoing unit 14 is provided on a coupling element 30 which is rotatably mounted on another axis of rotation 15 such that the coupling element 30 is operatively connected to the bearing unit 20. In another alternative embodiment (not shown) the outgoing unit 14 leading to the lock may be provided on the bearing unit 20 or on the grip element 40 or even on the stationary carrier 11. As shown in FIG. 2, the bearing unit 20 has an end face 21 which faces the grip element 40. Furthermore, the coupling element 30, which can be pivoted about the second axis of rotation 15, is configured with a contact area 31 on which the end face 21 acts during the movement of the bearing unit 20.

As illustrated in FIGS. 3 and 4, the bearing unit 20 together with the grip element 40 is pivotable out of a first position (see FIG. 3) into a second position (see FIG. 4) and vice-versa. The first position here is the resting position. During the movement from the first position into the second position, the outgoing unit 14 is operated, so that if a lock on a vehicle, which is not shown explicitly here, is already in the unlocking position, the vehicle door 12 can be opened in this way. In the present exemplary embodiment, the outgoing unit 14 is a Bowden cable which extends to the lock. The outgoing unit 14 is held on a receptacle 33 which forms a common component of the same material as the coupling element 30 and is pivotable about the second axis of rotation 15. The roll-type receptacle 33 is embodied as a groove 33*a*, in which the outgoing unit 14, in particular the Bowden cable, is guided and held. In operation of the grip element 40, the bearing unit 20 is pivoted about the first axis of rotation 13. At the same time the end face 21 presses on the contact area 31 of the coupling element 30 so that the coupling element 30 rotates about the second axis of rotation 15. During the movement of the bearing unit 20, the contact area 31 of the coupling element 30 rolls on the end face 21. In the first position of the bearing unit 20 according to FIGS. 1 and 3, the contact area 31 which is in contact with the end face 21 of the bearing unit 20 is at a defined distance from the second axis of rotation 15. While the coupling element 30 is rotating about the second axis of rotation 15, the receptacle 33 also rotates in the same direction of rotation, such that the Bowden cable 14 is wound onto the receptacle 33 by a certain amount. This results in a tensile force on the outgoing unit 14 which acts directly on the lock.

As illustrated in FIG. 3 and FIG. 4, the carrier 11 is connected to the pivotable bearing unit 20 on the inside 12 of the door. The grip element 40 is only subsequently attached to the lever 20 and to the first axis 13 namely from the outside of the door 12. As can be seen well in FIG. 1 to FIG. 4, the carrier 11 has a first and a second stop element 16*a*, 16*b*. The bearing unit 20 is in contact with the first stop element 16*a* on the right in its first position.

In addition, the inventive device has a spring element 32 which is operatively connected to the coupling element 30 and the bearing unit 20. In the second position of the bearing unit 20, the spring element 32 exerts such a restoring force that the bearing unit 20 automatically moves into its first position according to FIG. 1. In the present exemplary embodiment, the coupling element 30 has a journal 35 onto which the spring element 32 is attached (see FIG. 2).

The coupling element 30 is also designed with two mass equalizing weights 34 which are also moved out of the first position into the second position about the second axis of rotation 15 during the movement of the bearing unit 20. These mass equalizing weights 34 serve to prevent the bearing unit 20 from being unintentionally forced into its second position due to the resulting centrifugal forces in a side impact, for example, which would trigger an unwanted opening of the door 12. In this case the mass equalizing weights 34 counteract the centrifugal forces in effect, so that movement of the bearing unit 20 about the first axis of rotation 13 in the direction of the second position is prevented.

FIG. 5 shows another exemplary embodiment of the invention where the holding element 24 has at least one positioning means 22 so that a horizontal support of the first grip end 41 can be achieved. The positioning means 22 are formed by a groove 24*a* provided on the holding element 24. The groove 24*a* accommodates the first grip end 41 reliably. The remaining arrangement of the inventive device corresponds essentially to the exemplary embodiment according to FIG. 1 to FIG. 4. Whereas the grip element 40 is operated by the user, the bearing unit 20 is pivoted about the axis of rotation 13 so that the groove 24*a* holds the first grip end 41 in its horizontal position.

The carrier 11 is also designed with a passage 36 in which a closing cylinder (not shown) is inserted into the carrier 11 and secured there. The closing cylinder may also have an outlet which acts on the lock in operation of the lock cylinder, thereby locking or unlocking it.

The invention claimed is:

1. A device for operating a lock on a movable part of a motor vehicle, comprising:

a carrier that can be attached to an inside of the movable part, a bearing unit that can be pivoted about a first axis provided on the carrier and a grip element having a first and a second grip end, wherein the first and second grip ends are arranged on the bearing unit and both ends are in direct contact with the bearing unit, wherein the bearing unit is configured with a holding element at a distance from the first axis, the first grip end being arranged on the holding element such that the first grip end at least partially surrounds the holding element wherein when the grip element is being assembled onto the bearing unit, the first grip end can be pivoted on the holding element, wherein the holding element runs parallel to the first axis.

2. The device according to claim 1 wherein when the grip element is being assembled onto the bearing unit the first grip end is assembled to the holding element and then the second grip end is moved toward the bearing unit, to which the second grip end can be attached, by means of a pivoting movement of the grip element about the holding element.

3. The device according to claim 1, wherein the holding element together with the bearing unit forms a one-piece component.

4. The device according to claim 1, wherein the holding element has at least one positioning means so that a horizontal support of the first grip end can be achieved.

5. The device according to claim 4, wherein the at least one positioning means is formed by at least one groove provided on the holding element.

6. The device according to claim 1, wherein a fit with play exists between the first grip end and the holding element.

7. The device according to claim 1, wherein the first axis is formed by a pin on which the bearing unit is pivotably supported.

8. The device according to claim 1, wherein the first grip end is configured as an elongated hole open at one end.

9. The device according to claim 8, wherein the area of the first grip end that is open at one end is directed toward the first axis.

10. The device according to claim 8, wherein the area of the first grip end that is open at one end is directed toward the interior of the motor vehicle.

11. The device according to claim 1, wherein the first grip end is additionally attached to the holding element in a form-fitting and/or friction-locked and/or bonded manner after the first grip end has been assembled onto the holding element.

12. The device according to claim 1, wherein an outgoing unit leading to the lock is provided on the bearing unit.

13. The device according to claims 1, further comprising a coupling element rotatably mounted on a second axis of rotation and an outgoing unit leading to the lock is provided on the coupling element, wherein the coupling element is in operative connection with the bearing unit.

14. The device according to claim 13, wherein during a movement of the bearing unit from a first position into a second position, the coupling element moves about the second axis of rotation.

15. The device according to claim 14, further comprising a spring element in operative connection with the coupling element and the bearing unit such that in the second position of the bearing unit, the spring element exerts a restoring force, such that the bearing unit can be automatically moved into the first position.

16. The device according to claim 13, wherein the bearing unit is configured with an end face which faces the grip element, and the coupling element has a contact area on which the end face acts during a movement of the bearing unit.

17. The device according to claim 13, wherein the coupling element is configured with a receptacle in which the outgoing unit is held.

18. The device according to claim 13, wherein the coupling element has at least one mass equalizing weight.

19. The device according to claim 1, wherein the bearing unit together with the grip element can be pivoted out of a first position into a second position and vice-versa such that the bearing unit contacts a first stop element in the first position and/or the bearing unit contacts a second stop element in the second position.

20. The device according to claim 1, wherein the second grip end is attached to an end of the bearing unit facing away from the first axis.

* * * * *